US006164110A

United States Patent [19]

Seidel

[11] Patent Number: 6,164,110

[45] Date of Patent: Dec. 26, 2000

[54] METHOD OF OPERATING A ROLLING MILL STAND OF A ROLLING MILL TRAIN

[75] Inventor: Jürgen Seidel, Kreuztal, Germany

[73] Assignee: SMS Schloemann-Siemag AG, Düsseldorf, Germany

[21] Appl. No.: 09/433,415

[22] Filed: Nov. 4, 1999

[30] Foreign Application Priority Data

Nov. 4, 1998 [DE] Germany ..... 198 50 738

[51] Int. Cl.[7] ..... B21B 27/06

[52] U.S. Cl. ..... 72/201

[58] Field of Search ..... 72/201, 236, 39, 72/43, 200, 202

[56] References Cited

U.S. PATENT DOCUMENTS 4,706,480 11/1987 Svatos ..... 72/201
4,843,673 7/1989 Sendzimir et al. ..... 72/236

FOREIGN PATENT DOCUMENTS 0776710 6/1997 European Pat. Off. .

OTHER PUBLICATIONS

Patent Abstracts of Japan (European Patent Office).

*Primary Examiner*—Rodney A. Butler
*Attorney, Agent, or Firm*—Brown & Wood, LLP

[57] ABSTRACT

A method of operating a rolling mill stand of a rolling mill train and including upper and lower rolls having opposite roll edges, with the method including, rolling, in the rolling stand, a first metal strip having a first strip width, thereafter, after a rolling pause, rolling, in the rolling stand, a second metal strip having a second strip width, subjecting the rolls, during the rolling the first and second metal strip, to action of a cooling medium, and interrupting cooling of the rolls, at least in a contact region of the rolls with the second metal strip during rolling of the same, for a time period within the rolling pause between rolling of the first and second strips.

11 Claims, 2 Drawing Sheets

METHOD OF OPERATING A ROLLING MILL STAND OF A ROLLING MILL TRAIN

BACKGROUND OF THE INVENTION

1. Field of the Invention

The present invention relates to a method of operating a rolling mill stand of a rolling mill train and including upper and lower rolls having opposite roll edges, with the method including rolling, in the rolling stand, a first metal strip having a first strip width, thereafter, after a rolling pause, rolling, in the rolling stand, a second metal strip having a second strip width, and subjecting the rolls, during rolling of the first and second metal strips, to action of a cooling medium.

2. Description of the Prior Act

An operating method discussed above is disclosed, e.g., in European publication EP 0 776 710 A1. According to the known method, the contact regions of the work rolls, which are in contact with the strip edges, are cooled in a control manner so that the camber change, which is obtained as a result of cooling, counteracts to the edge drops resulting from the lateral flow of the strip material and the flattening of the work rolls.

Though the known process demonstrated more or less satisfactory results, it still needs improvement. This is because the previously adjusted camber changes during a rolling pause between rolling of two strips due to the cooling of the rolls.

Accordingly, an object of the present invention is to so improve the known method so that a most possible definable camber of the rolls is retained, whereby the strip profile and the strip flatness are improved.

SUMMARY OF THE INVENTION

This and other objects of the present invention, which will become apparent hereinafter, are achieved by interrupting cooling of the rolls, at least in the contact region of the rolls with a following metal strip during the rolling of the following metal strip, for a time period within a rolling pause between the rolling of the preceding and following strips.

An optium camber is obtained when the roll regions outside of the contact region are subjected to the action of the cooling medium also for the time period, during which the cooling of the contact region is interrupted.

When the cooling medium when being applied to the rolls, has a velocity component directed to the roll edges, the cooling medium cannot reach the contact region.

The contact region of the rolls, the cooling of which is interrupted for the time period within the rolling pause, can have a width smaller than the width of the second or following metal strip. In this case, the camber would be particularly large. Usually, the contact region width is smaller than that of the second strip by maximum 200 mm. I.e., regions of up to 100 mm, which are provided on opposite sides of the contact region and which would contact the second strip during its rolling, are subjected to the action of the cooling medium also for the time period, within the rolling pause during which the cooling of the contact region is interrupted.

The temperature of the rolls varies during the rolling process. The deformation of the second metal strip depends on the strip material and the temperature. For improving the rolling characteristics during the rolling of the second strip, advantageously, the time period, during which the cooling is interrupted, is determined in accordance with at least one of the temperatures, which the rolls have during rolling.

When the rolls of the rolling mill stand includes work and backup rolls and, if necessary, intermediate rolls, and the work rolls are subjected or not subjected to the action of the cooling medium, a particularly high efficiency is achieved.

To prevent or to reduce the wear of the rolls, which results from turning the delivery of the cooling medium off, the rolls are driven during the rolling internal with a rotational speed which is noticeably smaller than the roll operational speed. As a result, in this case, minimum energy is required.

When the rolls are associated with respective wipers, a particularly small wear of the rolls and the wipers is observed when the wipers are disengaged from the rolls during the rolling pause and/or the pressure applied by the wipers to the rolls is significantly reduced.

The novel features of the present invention, which are considered as characteristic for the invention, are set forth in particular in the appended claims. The invention itself, however, both as to its construction and its mode of operation, together with additional advantages and objects thereof, will be best understood from the following detailed description of preferred embodiments, when read with reference to the accompanying drawings.

DETAILED DESCRIPTION OF THE PREFERRED EMBODIMENT

Figure 1:
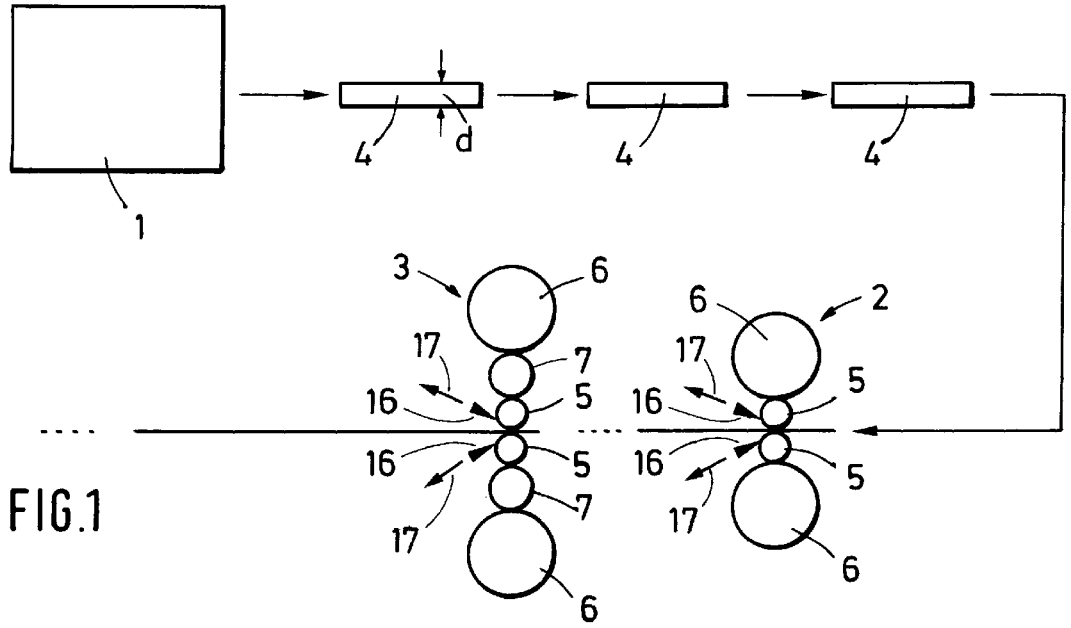
FIG. 1 a schematic view of a continuous casting plant with a rolling mill train located downstream of the plant.

FIG. 1 shows a continuous casting plant 1 downstream of which, there is provided a rolling mill train including a plurality of rolling mill stands. In FIG. 1, only a front rolling mill stand 2 and a rear rolling mill stand 3 are shown.

The continuous casting plant 1 is a so-called thin slab casting plant. It can be formed as a single-strand plant or a multi-strand plant. This plant is capable of producing a metal strip with a thickness d in a range from 40 to 150 mm. The strip thickness d is substantially the same for the entire strip. The metal strip 4 has a strip width b which can vary in a range from 400 to 2,000 mm. FIG. 1 shows three metal strips 4 which may have a thickness of between 50 and 80 mm, e.g., 50 mm. The strips have a width b, e.g., of 1,000, 1,200 and 2,000 mm.

The strips 4 are rolled in the rolling stands 2 and 3 one after another. A rolling pause P exists between rolling of separate strips 4.

As shown in FIG. 1, the rolling mill stands 2 and 3 have upper and lower work rolls 5 and upper and lower backup rolls 6. The rear rolling mill stand 3 can have, e.g., intermediate upper and lower rolls 7. All of the rolls from 5 to 7 become heated during the rolling process, whereby their camber changes.

The camber change is the greatest in the rolls 5 as they are heated most during rolling.

During the rolling of the metal strips 4, the rolls 5–7, in particular, the work rolls 5, are subjected to action of a cooling medium 10 along their entire width, i.e., from a roll edge 8 to a roll edge 9.

Figure 2:
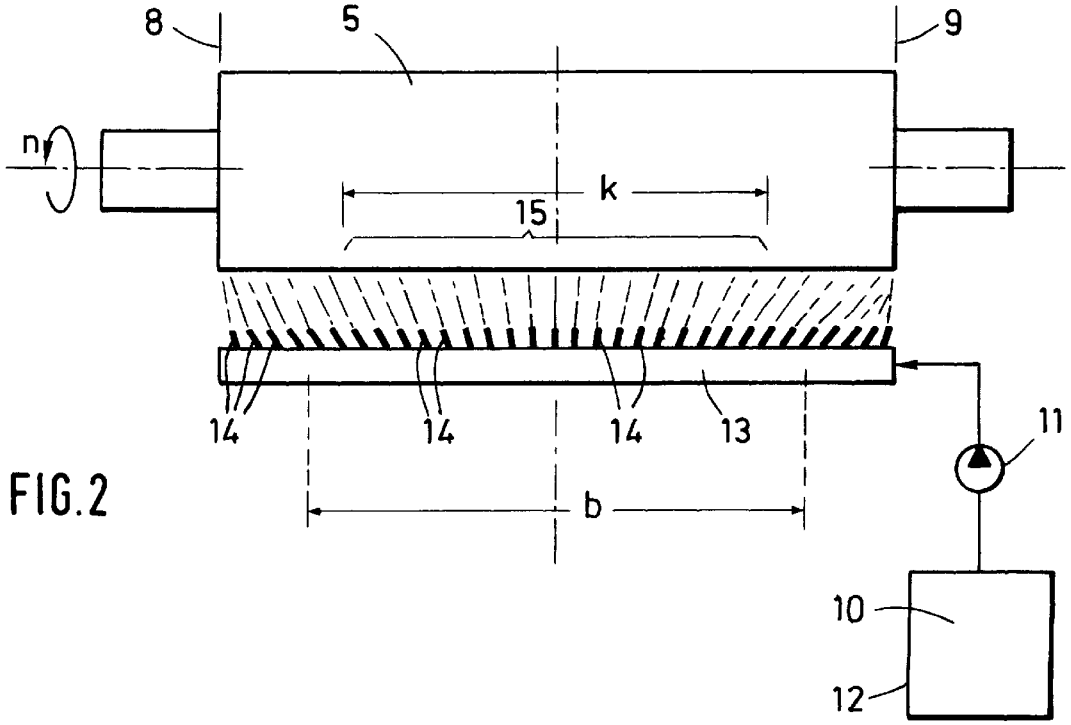
FIG. 2 a schematic view of a work roll with a spraying device.

The cooling medium 10 is delivered by a pump 11 from a reservoir 12 to a spray girder 13. From the spray girder 13, the cooling medium 10 is sprayed onto the work roll 5 through a plurality of spray nozzles 14, as shown in FIG. 2. The spray nozzles 14 are turned on and off separately or in groups. The spray nozzles 14 are so oriented that the cooling medium 10 has a velocity component directed toward the roll edges 8 and 9.

Figure 3:
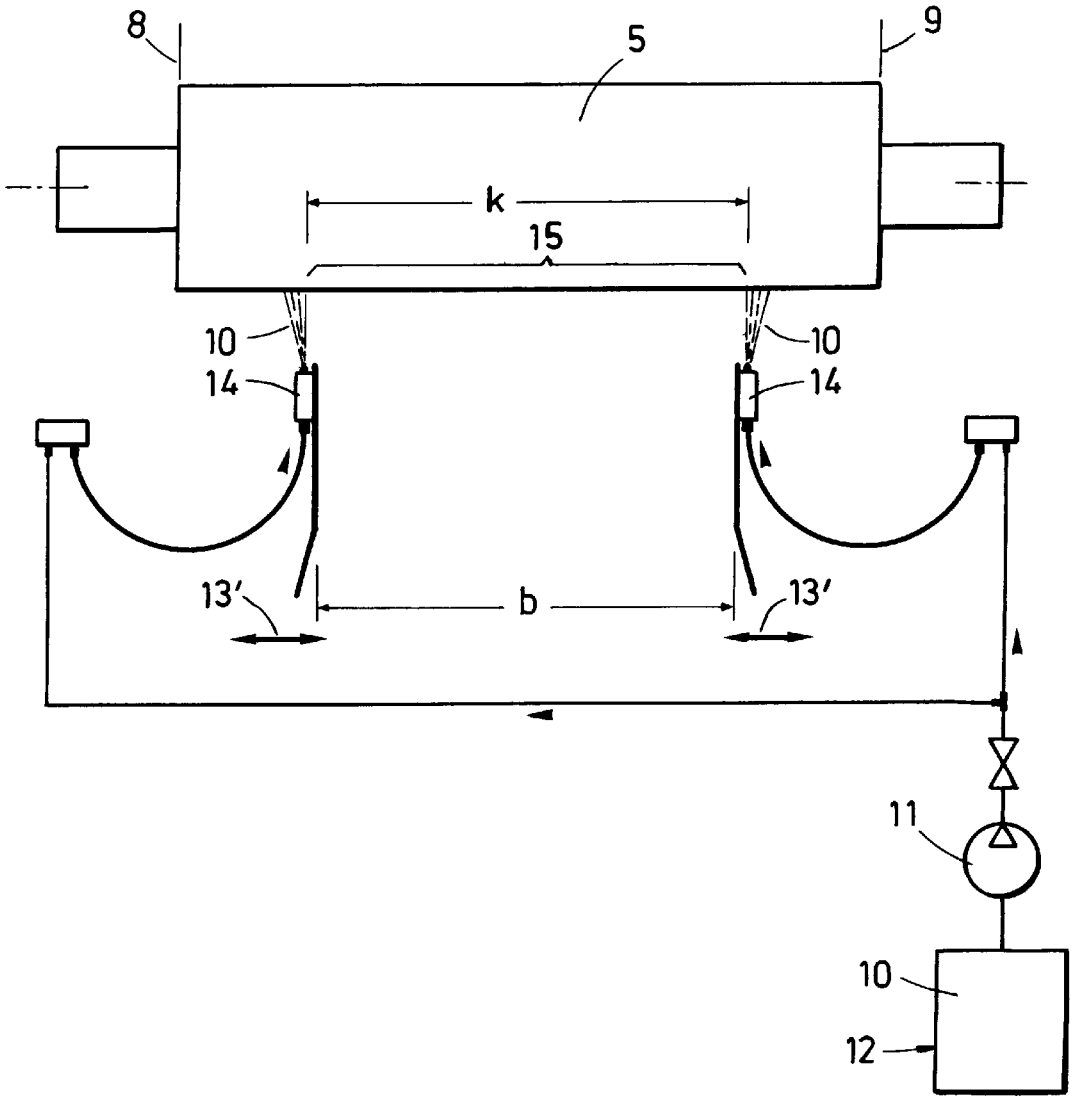
FIG. 3 a schematic view of a work roll with another type of a spraying device.

Besides the above-described cooling of the rolls 5–7 outside of the contact region 15 with a stationary spray girder 13 which is divided in several zones, sidewise displaceable spray girders can be used. Sidewise displaceable spray girders are shown in FIG. 3, where arrows 13' show the displacement of the spray girders. Each of the spray girders has a plurality of spray nozzles 14. For clarity sake, only one spray nozzle 14 is shown for each spray girder. As a displacement mechanism, a side guide, which is already available in a hot strip rolling train, can be used. A plurality of spray nozzles can be mounted on the outer side of the side guide so that they cover the contact region k. With the spray nozzles, the work roll 5 is cooled. The displaceable spray nozzles are activated only in the rolling pause P for a time period T. The spray nozzles 14 are so oriented that the cooling medium 10 is discharged sidewise.

As it has already been pointed out above, during rolling of the metal strip 4, the entire work roll 5 is subjected to the action of the cooling medium 10. During the rolling pause P, at least in the time period T, the working roll 5 is not subjected to the action of the cooling medium in the contact region 15. The contact region 15 is a region of the work roll 5 which contacts a following metal strip 4 during the rolling of the same. However, the contact region 15 need not necessarily extend over the entire strip width b of the following metal strip 4. The contact region 15 can be smaller than the width of the following metal strip 4. In this case, the contact region 15 has a width k which is smaller than the width of the following strip 4. Outside of the contact region 15, the working rolls 5 are subjected to the action of the cooling medium 10 also during the rolling period T.

After the preceding metal strip 4 runs out of the respective rolling mill stand 2, 3, for the determination of the time period T, a calculation is made how the camber of the work rolls 5 would change if the contact region 15 is subjected to the action of the cooling medium during the entire rolling pause P. Then, a calculation is made as to what the camber will be if the contact region 15 is not subjected to the action of the cooling medium during the entire rolling pause P. This interactive calculation permits to determine the desired time period T.

During the rolling pause P, the work rolls 5 rotate with a rotational speed R which is noticeably smaller than the operational speed R max of the work rolls 5. The rotational speed R, e.g., can be below 5–10% of the operational speed R max.

Naturally, both the time period T and the rotational speed R can be determined separately for each rolling mill stand 2, 3. E.g., the work rolls 5 become heated during the rolling of separate strip 4. The roll temperature after the end of rolling of the first metal strip 4 influences the extent to which the work rolls 5 need or need not be cooled and, thereby determines the length of the time period T. Thereby, the roll temperatures, in particular of the work rolls 5, are measured and are communicated to a camber calculator, not shown, for the determination of the time period T. The time period T can, e.g., because of wear and/or temperature differences, can be different for upper and lower work rolls 5. Also, the contact region k during the time period T can vary.

Further, the actual camber can depend on the rolling force with which the second metal strip 4 is rolled. The rolling force is a function of the pass reduction, the temperature, the material (the steel type) of the second strip 4. All of these parameters also influence the length of the time period T.

The influence of the adjusted camber on the metal strip 4 is monitored by using a strip profile and surface evenness model. This prevents the strip from acquiring negative characteristics, such as sharp edges or strip beads.

As shown in FIG. 1, wipers 16 are associated with the work rolls 5. The wipers 16 are adjusted so that they engage the work rolls 5 with a certain pressure. In order to minimize the wear of the work rolls 5, during the rolling pause P, the wipers 16 are disengaged from the work rolls 5. This is symbolically shown in FIG. 1 with arrows 17.

Alternatively, the applied to the work rolls 5 pressure can be reduced by delivering at the same time, a small amount of the cooling medium with separate spray nozzles in the region wiper 16/work roll 5. With regard to cooling of the work rolls 5, this amount is quite negligible, however, it acts as a lubrication and prevents an excessive wear of the work rolls 5 and the wipers 16.

The thermal camber of work rolls 5 can be further increased when, in addition to not cooling the work rolls 5 during the time period T, the amount of the cooling medium 10, which is applied during rolling, is reduced. A predetermined rolling temperature can be established with a computer model and by measuring the actual rolling temperature. Dependent, e.g., on the reduction of the strip thickness, a minimal tolerated amount of the cooling medium 10 for cooling the work rolls 5 is determined. E.g., for reduction of the strip thickness by 50%, a full amount of the cooling medium is used for cooling the work rolls 5. For reduction of the strip thickness by 35%, 60% of the full amount is used.

Though the present invention was shown and described with references to the preferred embodiments, various modifications thereof will be apparent to those skilled in the art and, therefore, it is not intended that the invention be limited to the disclosed embodiments or details thereof, and departure can be made therefrom within the spirit and scope of the appended claims.

What is claimed is:

1. A method of operating a rolling mill stand of a rolling mill train and including upper and lower rolls having opposite roll edges, the method comprising the steps of:

rolling, in the rolling stand, a first metal strip having a first strip width;

thereafter, after a rolling, pause, rolling, in the rolling stand, a second metal strip having a second strip, different from a first strip width;

subjecting the rolls, during the first and second metal strip, to action of a cooling medium; and interrupting, during the rolling pause between the rolling of the first and second strips, cooling of the rolls, at least in a contact region of the rolls with the second metal strip during rolling of the same, for a predetermined period.

2. A method as set forth in claim 1, wherein the step of subjecting the rolls to the action of the cooling medium includes applying a cooling medium having a velocity component directed toward the opposite edges of the rolls.

3. A method as set forth in claim 1, wherein the contact region of the rolls with the second metal strip has a width which is smaller than the second width of the second metal strip.

4. A method as set forth in claim 1, comprising the step of rotating the rolls during the rolling pause speed which is noticeably smaller than an operational speed of the rolls.

5. A method as set forth in claim 1, wherein the cooling interrupting step includes determining the time period, for which the cooling is interrupted, dependent on a determined temperature of the rolls.

6. A method as set forth in claim 1, wherein the time period, for which the cooling is interrupted, is different for upper and lower rolls.

7. A method as set forth in claim 1, wherein the contact region has a variable width.

8. A method as set forth in claim 1 wherein the rolling mill stand includes adjustable wipers associated with work rolls and applying a certain pressure thereto, and wherein the method includes the step of one of disengaging the wipers from the work roll and reducing pressure applied by the wipers to the work roll during the rolling pause.

9. A method as set forth in claim 7, comprising the step of displacing at least one spray girder having a plurality of spray nozzles along a guide for varying the width of the contact region.

10. A method as set forth in claim 9, wherein the displacing step includes forming the guide as a side guide.

11. A method as set forth in claim 8, comprising the step of delivering a small amount of the cooling medium with separate nozzles into a region of engagement of the wipers with the work rolls during the rolling pause.

* * * * *